US008699902B2

(12) United States Patent
Hirai

(10) Patent No.: US 8,699,902 B2
(45) Date of Patent: Apr. 15, 2014

(54) IMAGE FORMING APPARATUS OF INTERMEDIATE TRANSFER METHOD, INCLUDING PRE-SECONDARY-TRANSFER CHARGING SECTION AND CONCENTRATION DETECTION SECTION

(75) Inventor: Masashi Hirai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 387 days.

(21) Appl. No.: 13/179,594

(22) Filed: Jul. 11, 2011

(65) Prior Publication Data

US 2012/0020686 A1 Jan. 26, 2012

(30) Foreign Application Priority Data

Jul. 20, 2010 (JP) ..... 2010-162594

(51) Int. Cl.
*G03G 15/10* (2006.01)
*G03G 15/00* (2006.01)
*G03G 15/08* (2006.01)

(52) U.S. Cl.
CPC ..... *G03G 15/5033* (2013.01); *G03G 15/0827* (2013.01); *G03G 2215/00042* (2013.01)
USPC ..... 399/60; 399/49

(58) Field of Classification Search
CPC ..... G03G 15/5033; G03G 15/0827; G03G 2215/00042
USPC ..... 399/49, 302, 60
See application file for complete search history.

(56) References Cited

U.S. PATENT DOCUMENTS

| | | | | |
|---|---|---|---|---|
| 5,512,986 | A * | 4/1996 | Toyomura et al. | 399/60 |
| 8,455,851 | B2 * | 6/2013 | Tanaka et al. | 250/559.16 |
| 2005/0135821 | A1 * | 6/2005 | Martin et al. | 399/49 |
| 2007/0292170 | A1 * | 12/2007 | Yoshioka | 399/299 |

FOREIGN PATENT DOCUMENTS

| | | | |
|---|---|---|---|
| JP | 03-063165 | U | 6/1991 |
| JP | 2003-057959 | A | 2/2003 |
| JP | 2008-241958 | A | 10/2008 |

* cited by examiner

*Primary Examiner* — Walter L Lindsay, Jr.
*Assistant Examiner* — Rodney Bonnette
(74) *Attorney, Agent, or Firm* — Renner, Otto, Boisselle & Sklar, LLP

(57) ABSTRACT

An image forming apparatus includes a PTC and a toner concentration sensor that are disposed adjacent to and downstream of a fourth image forming unit. The PTC and the toner concentration sensor are opposed to an intermediate transfer belt. A counter roller is opposed to the PTC across the intermediate transfer belt. The counter roller moves to, during the toner concentration detection, a position opposed to the toner concentration sensor across the intermediate transfer belt. Compared to the PTC and the toner concentration sensor each having a counter roller, less rollers may be provided, thereby reducing degradation of the intermediate transfer belt due to wear.

5 Claims, 7 Drawing Sheets

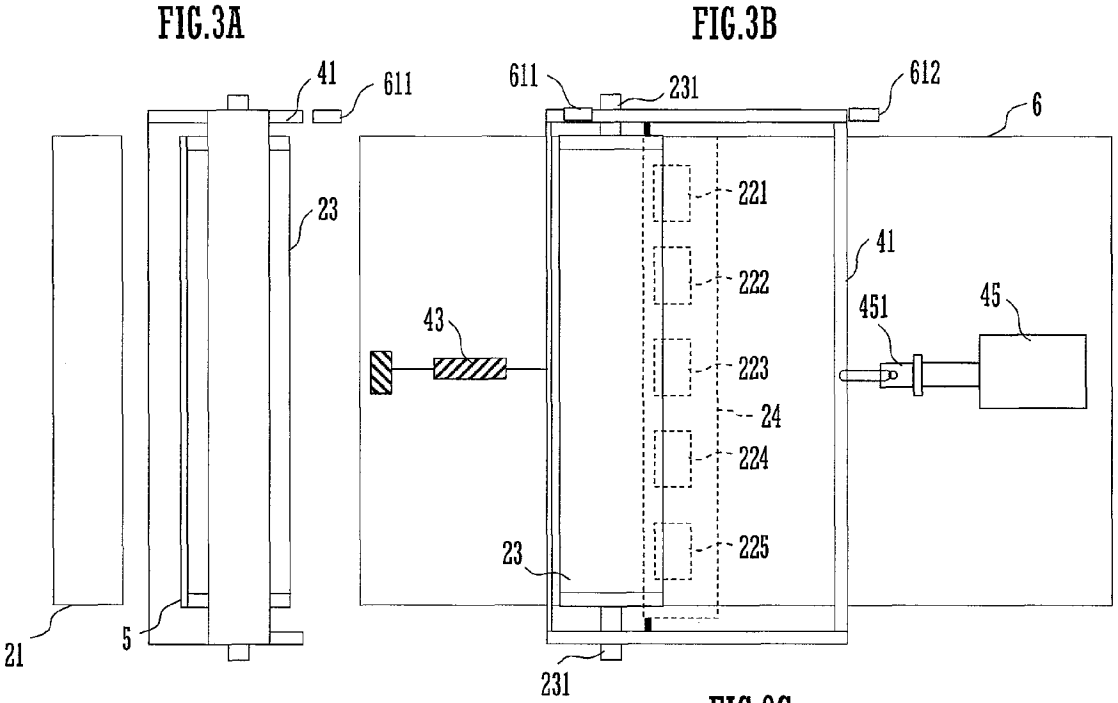
FIG.3A
FIG.3B
6
612
611
231
41
221
222
223
24
224
225
451
45
23
43
5
21
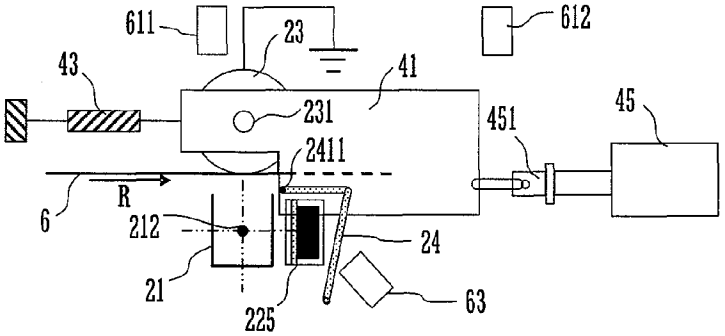
FIG.3C
612
611
41
23
231
2411
24
63
225
451
45
212
21
R
6
43

IMAGE FORMING APPARATUS OF INTERMEDIATE TRANSFER METHOD, INCLUDING PRE-SECONDARY-TRANSFER CHARGING SECTION AND CONCENTRATION DETECTION SECTION

CROSS REFERENCE

This Nonprovisional application claims priority under 35 U.S.C. §119(a) on Patent Application No. 2010-162594 filed in Japan on Jul. 20, 2010, the entire contents of which are hereby incorporated by reference.

BACKGROUND OF THE INVENTION

The present invention relates to an image forming apparatus of the intermediate transfer method, and more particularly, to an image forming apparatus including a pre-secondary-transfer charging section and a concentration detection section.

An image forming apparatus of the intermediate transfer method forms a color toner image as follows. Toner images are formed on photoreceptor surfaces for hues of yellow, magenta, cyan, and black. An intermediate transfer belt is rotated while transferring the toner images sequentially onto the belt and overlapping the images thereon at a primary transfer position at which the photoreceptor and the intermediate transfer belt contact each other. The image forming apparatus then transfers the color toner image formed on the intermediate transfer belt to a sheet at a secondary transfer position at which the intermediate transfer belt and the sheet contact each other.

Some conventional image forming apparatuses, as described by Japanese published unexamined application No. 2003-57959 for example, improve the transferability at the secondary transfer position by providing, in the traveling direction of the intermediate transfer belt, a pre-secondary-transfer charger upstream of the secondary transfer position, and applying to the toner images on the intermediate transfer belt a charge of the same polarity as the toner charge polarity. These image forming apparatuses apply a uniform charge from the pre-secondary-transfer charger to the toner image by reducing oscillation of the intermediate transfer belt by providing a first roller at a position opposed to the pre-secondary-transfer charger across the intermediate transfer belt.

Other conventional image forming apparatuses, as described by Japanese published unexamined application No. 2008-241958 for example, improve the image quality by optically sensing the toner concentration of the toner image pattern on the intermediate transfer belt with a toner concentration sensor, and controlling the toner concentration depending on the sensing results. These image forming apparatuses improve the toner image detection accuracy by reducing oscillation of the intermediate transfer belt by providing a second roller at a position opposed to the toner concentration sensor across the intermediate transfer belt.

The combination of the ideas described by Japanese published unexamined applications No. 2003-57959 and No. 2008-241958 may provide the image forming apparatus with the pre-secondary-transfer charger and the toner concentration sensor to improve the transferability and to improve the image quality.

Unfortunately, in the image forming apparatus, the first roller at the position opposed to the pre-secondary-transfer charger and the second roller at the position opposed to the toner concentration sensor, as described above, can cause more rollers to rub the intermediate transfer belt, thereby facilitating the wear of the intermediate transfer belt and reducing the durability thereof.

Absence of the first and second rollers can cause oscillation of the intermediate transfer belt during the rotation. The charge applied to the toner image by the pre-secondary-transfer charger thus varies and the toner concentration sensor detects the toner image pattern at reduced accuracy, thereby reducing the image quality.

In view thereof, it is an object of the invention to provide an image forming apparatus that reduces the wear of the intermediate transfer belt to improve the durability thereof. It is another object of the present invention to provide an image forming apparatus that improves the transferability to provide a higher quality image.

SUMMARY OF THE INVENTION

The image forming apparatus of this invention includes an intermediate transfer belt, a concentration detection section, a pre-secondary-transfer charging section, a counter roller, and a movement section. The intermediate transfer belt is extended into a loop by a plurality of rollers. The belt receives a toner image transferred from an image bearing member and conveys the image to a secondary transfer position. The concentration detection section is opposed to the intermediate transfer belt. The detection section detects the concentration of the toner image primarily transferred to the intermediate transfer belt. The section thus controls the concentration of a toner image to be formed on the image bearing member. The pre-secondary-transfer charging section is disposed adjacent to the concentration detection section in the conveyance direction of the toner image transferred to the intermediate transfer belt. The charging section applies a charge to the toner image primarily transferred to the intermediate transfer belt to reduce the variation of the charge amount of the toner image. The counter roller is one of the rollers extending the intermediate transfer belt. The roller is movable between a first position opposed to the pre-secondary-transfer charging section across the intermediate transfer belt and a second position opposed to the concentration detection section across the intermediate transfer belt. The movement section moves the counter roller to the first position when the pre-secondary-transfer charging section applies a charge to the toner image. The movement section also moves the counter roller to the second position when the concentration detection section detects the concentration of the toner image.

In this configuration, the counter roller works both as a first roller opposed to the concentration detection section across the intermediate transfer belt and as a second roller opposed to the pre-secondary-transfer charging section across the intermediate transfer belt. The image forming apparatus usually performs, at different timings, a process of applying a charge to the toner image primarily transferred to the intermediate transfer belt (an image forming process) and a process of detecting the concentration of the toner image. The counter roller may thus work both as the first roller and as the second roller by positioning the counter roller depending on the two processes. This may thus decrease the number of rollers extending the intermediate transfer belt, i.e., rollers rubbing the intermediate transfer belt, thereby reducing the wear of the intermediate transfer belt to improve the durability thereof.

Also, as described above, depending on the process, the counter roller may be opposed to the pre-secondary-transfer charging section or the concentration detection section across the intermediate transfer belt to reduce the oscillation of the rotating intermediate transfer belt. The pre-transfer charging section may thus apply a uniform charge to the toner image on the intermediate transfer belt. The concentration detection section may also detect the toner image at improved accuracy.

In this way, this invention may reduce the wear of the intermediate transfer belt to improve the durability thereof. In addition, the transferability may be improved to provide a higher quality image.

BRIEF DESCRIPTION OF THE DRAWINGS

FIG. 3A is a side view of the configuration of a movement mechanism of the counter roller;

FIG. 3B is a plan view of the configuration of a movement mechanism of the counter roller;

FIG. 3C is a front view of the configuration of a movement mechanism of the counter roller;

DETAILED DESCRIPTION OF THE INVENTION

Figure 1:
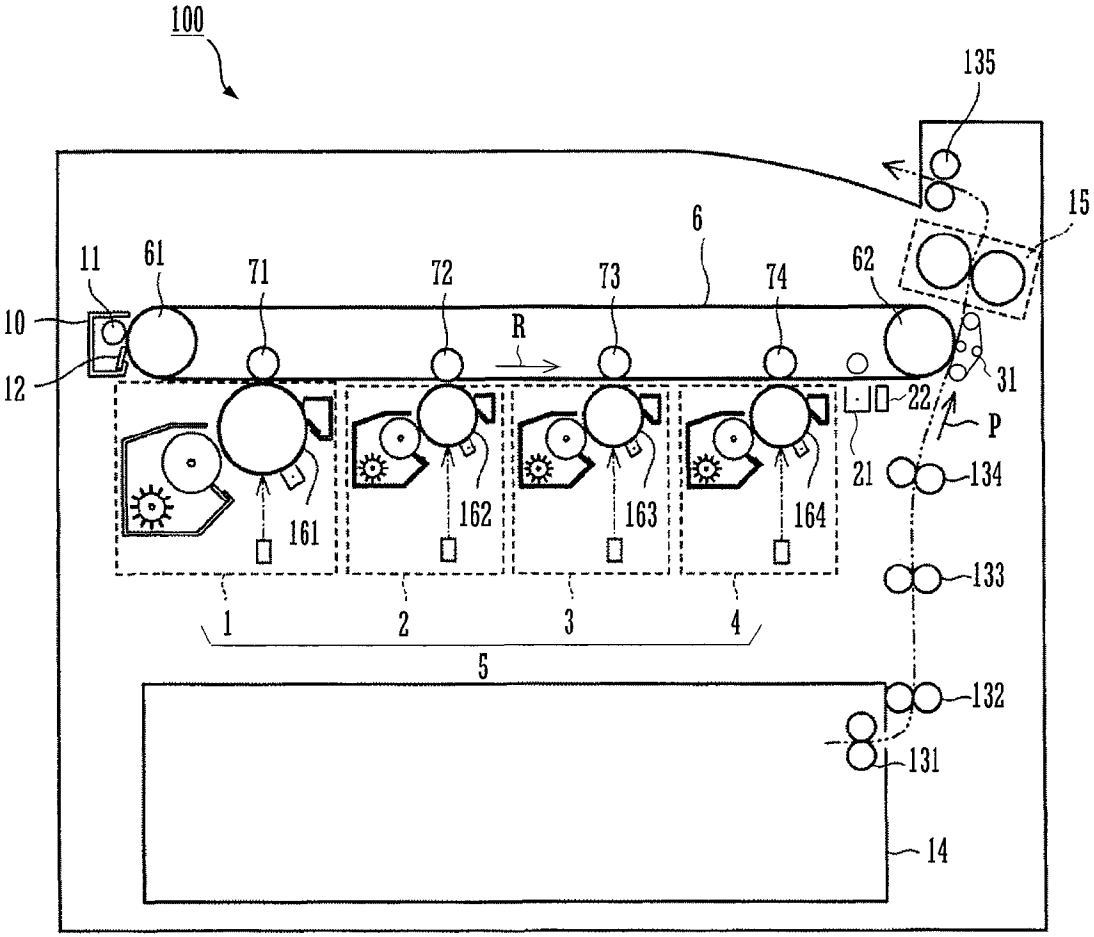
FIG. 1 illustrates a schematic configuration of an image forming apparatus according to an embodiment of the present invention.

FIG. 1 shows an image forming apparatus 100. The forming apparatus 100 is a color image forming apparatus of the tandem method. The apparatus 100 includes, a first image forming unit 1 for forming a yellow toner image, a second image forming unit 2 for forming a magenta toner image, a third image forming unit 3 for forming a cyan toner image, and a fourth image forming unit 4 for forming a black toner image. The four image forming units included in the image forming apparatus 100 are hereinafter collectively referred to as an image forming unit group 5.

With reference to FIG. 1, an endless intermediate transfer belt 6 is disposed above the image forming unit group 5. The intermediate transfer belt 6 is hung on two support rollers 61 and 62 and is extended into a loop by the rollers. The transfer belt 6 rotates in a direction indicated by the arrow R. The intermediate transfer belt 6 is made of resin such as polyimide or polyamide containing an electron conductive material.

The image forming unit group 5 is disposed, from the upstream in the arrow R direction along the intermediate transfer belt 6, in the order of the first image forming unit 1, the second image forming unit 2, the third image forming unit 3, and the fourth image forming unit 4.

The intermediate transfer belt 6 has primary transfer rollers 71, 72, 73, and 74 disposed on its inner surface side. The primary transfer rollers transfer single color toner images formed by the image forming unit group 5 onto the intermediate transfer belt 6, respectively. The primary transfer rollers 71, 72, 73, and 74 extend the intermediate transfer belt 6. Photoreceptor drums (image bearing members) 161, 162, 163, and 164 are provided in the image forming unit group 5. The rollers 71, 72, 73, and 74 are opposed to the respective drums 161, 162, 163, and 164 across the intermediate transfer belt 6. The single color toner images formed by the image forming unit group 5 are sequentially transferred (primarily transferred) to the intermediate transfer belt 6 and are overlapped thereon to provide one color toner image. The intermediate transfer belt 6 conveys the primarily transferred toner images to a position (a secondary transfer position) at which the support roller 62 and a secondary transfer belt 31 as described below are opposed to each other. In the arrow R direction, which is the rotational direction of the intermediate transfer belt 6, the support roller 61 side is hereinafter referred to as the upstream side and the support roller 62 side is the downstream side.

Downstream of the fourth image forming unit 4, a pre-secondary-transfer charger ("a pre-transfer charger" (PCT)) 21 and a toner concentration sensor 22 are disposed adjacent to each other in the conveyance direction, i.e., the arrow R direction, of the toner image primarily transferred to the intermediate transfer belt 6. The PTC 21 and the toner concentration sensor 22 are opposed to the intermediate transfer belt 6. The pre-secondary-transfer charger 21 comprises a pre-secondary-transfer charging section. The toner concentration sensor 22 comprises a concentration detection section.

In order to improve the transferability of the color toner image, the PTC 21 applies to, during the image forming process, the color toner image on the intermediate transfer belt a charge of the same polarity as the toner charge polarity to reduce the variation of the charge amount of the toner image.

In order to control the concentration of the toner images formed by the image forming unit group 5 to improve the image quality, the toner concentration sensor 22 performs a process control process. The process control process includes optically sensing, during non-image-forming processes, the toner concentration of the toner image patterns on the intermediate transfer belt transferred from the photoreceptor drums to control the toner concentration. The toner concentration sensor may preferably be, for example, an optical sensor for detecting the concentration of the toner image. The image forming apparatus 100 performs the process control process on power-up under a predetermined condition or for every certain n period (for example, every time the cumulative copy number or the cumulative running time reaches a certain amount).

The image forming apparatus 100 performs the process control process as follows. The apparatus 100 forms toner patches as the toner image patterns on the surfaces of the photoreceptor drums 161 to 164 in the image forming unit group 5 via the image forming process. The apparatus 100 then detects the concentration of the toner patches transferred to the intermediate transfer belt 6 by the toner concentration sensor to control the toner concentration to a predetermined concentration.

Note that the toner patch concentration will be changed by several things, for example: degradation of the photoreceptor drums 161 to 164 or the toner; humidity change; change of the charging voltage for charging the surface of the photoreceptor drums 161 to 164; and change of the exposure amount of a document. Therefore, the constant image concentration may be provided as follows: setting the charged potential to several levels; reading the concentrations of the toner patches formed at the respective charged potentials; determining one of the read concentrations that approximates a predetermined concentration; and setting the charged potential of the toner patch having the determined concentration as the charged potential during the copy process. The image concentration changed due to the degradation of the photoreceptor drums such as 161 to 164 and the environmental condition may be corrected by the charged potentials of the photoreceptor drums 161 to 164.

The secondary transfer belt 31 is disposed at a position opposed to the support roller 62 across the intermediate transfer belt 6. The secondary transfer belt 31 transfers the color image formed on the intermediate transfer belt 6 to a sheet. The sheet includes recording media such as plain paper, cardboard, and an OHP film.

A belt cleaning unit 10 is provided at a position opposed to the support roller 61 across the intermediate transfer belt 6. The belt cleaning unit 10 is adapted to clean the surface of the intermediate transfer belt 6. The belt cleaning unit 10 includes a belt cleaning brush 11 disposed in contact with the intermediate transfer belt 6 and a belt cleaning blade 12. The cleaning unit 10 removes a toner or toner patch that is not transferred to a sheet and remains on the intermediate transfer belt 6.

With reference to FIG. 1, a tray 14 for containing sheets is disposed below the image forming unit group 5. Sheets in the tray 14 are conveyed by a plurality of feed rollers 131 to 134 in the sheet conveyance direction indicated by the arrow P to the secondary transfer position at which the secondary transfer belt 31 is opposed to the intermediate transfer belt 6. At the secondary transfer position, the color toner image on the intermediate transfer belt 6 is secondarily transferred to a n sheet.

A fixing unit 15 is disposed downstream of the secondary transfer position in the sheet conveyance direction P. The fixing unit 15 fixes the color toner image to a sheet. A sheet is output by a paper exit roller 135 from the image forming apparatus 100.

A description is now given of the specific configurations of the PTC 21, the toner concentration sensor 22, and their surroundings.

Figure 2:
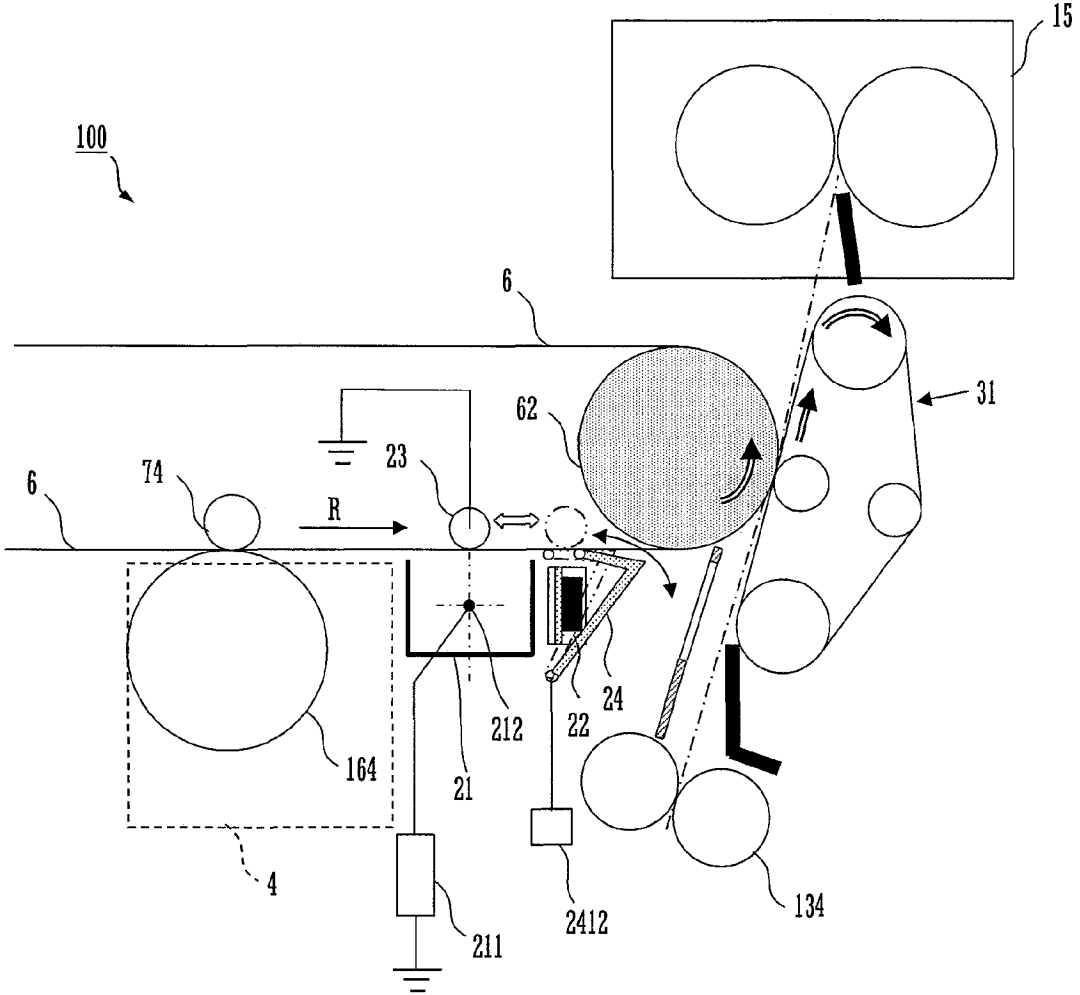
FIG. 2 is an enlarged view of a PTC, a toner concentration sensor, and their surroundings.

With reference to FIG. 2, the PTC 21 contains an electrode 212 at its central portion. The electrode 212 is connected to the PTC bias power supply 211. During the image forming process, the electrode 212 applies a charge supplied from the PTC bias power supply 211 to the toner image primarily transferred to the intermediate transfer belt 6.

A counter roller 23 is opposed to the electrode 212 of the PTC 21 across the intermediate transfer belt 6. The counter roller 23 is a driven roller driven by the intermediate transfer belt 6. The roller 23 extends the intermediate transfer belt 6. The counter roller 23 is connected to the earth i.e., is electrically grounded. The roller 23 is used as an earth roller during the image forming process. Specifically, an extra charge applied onto the toner image on the intermediate transfer belt 6 by the PTC 21 is led to the earth via the counter roller 23.

The counter roller 23 is opposed to the PTC 21 across the intermediate transfer belt 6 during the image forming process. This may reduce the oscillation of the intermediate transfer belt 6 and the toner image when the color toner image passes a position opposed to the PTC 21. The PTC 21 may thus apply a uniform charge to the toner image.

The counter roller 23 is adapted to be movable along the intermediate transfer belt 6 between two positions: a first position opposed to the electrode 212 of the PTC 21 across the intermediate transfer belt 6; and a second position opposed to the toner concentration sensor 22 across the intermediate transfer belt 6. The counter roller 23 is moved by a movement mechanism as described below. The image forming apparatus 100 opposes the counter roller 23 to the toner concentration sensor across the intermediate transfer belt 6 during the process control process (non-image-forming processes) in which the toner concentration sensor 22 detects the concentration of the toner image (the toner patch) transferred to the intermediate transfer belt 6.

The counter roller 23 moved to the above position may reduce the oscillation of the intermediate transfer belt 6 and the toner image when the toner image (the toner batch) passes a position opposed to the toner concentration sensor 22. The toner concentration sensor 22 may thus accurately detect the toner patch concentration.

In this way, according to the present invention, the counter roller 23 is opposed to the PTC 21 during the image forming process, and is opposed to the toner concentration sensor 22 during the toner concentration detection. Less rollers, i.e., less members rubbing the intermediate transfer belt 6 may thus be used than when the counter roller is provided for each of the PTC 21 and the toner concentration sensor 22. This may reduce the wear of the intermediate transfer belt 6, thereby improving the durability thereof.

The toner concentration sensor 22 includes a cover 24. The cover 24 is movable between two positions: a closing position for closing a detection surface opposed to the intermediate transfer belt 6; and an opening position for opening the detection surface. The cover 24 comprises a cover member. The cover 24 is moved by an opening and closing section 2412.

During the image forming process, i.e., when the PTC 21 applies a charge to the toner image primarily transferred to the intermediate transfer belt 6, the cover 24 is moved to the close position to close the detection surface of the toner concentration sensor 22, which is opposed to the intermediate transfer belt 6. The cover 24 closing the detection surface of the toner concentration sensor 22 prevents adhesion of dust such as a paper powder or a toner scatter on the detection surface. When the toner concentration is detected during non-image-forming processes, the cover 24 is moved to the opening position to open the detection surface of the toner concentration sensor 22, which is opposed to the intermediate transfer belt 6.

A description is now given of the toner concentration sensor 22 and a movement mechanism for moving the counter roller 23.

Note that in FIGS. 3C, 6A, 6B, and 7C, for clarity of the positions of the toner concentration sensor 22 and the cover 24, a holder 41 is shown transparent.

With reference to FIGS. 3A to 3C, the counter roller 23 has a rotating shaft 231 rotatably held by the holder 41. The rotating shaft 231 of the counter roller 23 is disposed in a direction perpendicular to the motion direction (the direction of the arrow R shown in FIG. 3C) of the intermediate transfer belt 6.

By way of example, the holder 41 is shaped like a frame of four boards. In the motion direction of the intermediate transfer belt 6, the upstream side of the holder 41 is connected to the first end of a spring 43 and the downstream side is connected to a solenoid 45. The second end of the spring 43 is fastened to the main frame of the image forming apparatus 100. The counter roller 23 is thus movable in parallel directions (the arrow R direction and the reverse direction) with the motion direction of the intermediate transfer belt 6.

With reference to FIG. 3C, roller position detection sensors 611 and 612 are provided above the holder 41. The roller position detection sensors 611 and 612 detect the positions of both ends of the holder 41 to detect the position of the counter roller 23.

The holder 41 is moved by the spring 43 and the solenoid 45.

Note that the holder 41, the spring 43, and the solenoid 45 correspond to a movement section.

The number of toner concentration sensors 22 may preferably be adjusted depending on the number or positions of toner images (toner patches) transferred to the intermediate transfer belt 6. When, for example, in the direction perpendicular to the motion direction (the arrow R direction) of the intermediate transfer belt 6 i.e., in the width direction of the intermediate transfer belt 6, five toner patches are provided, five toner concentration sensors 221 to 225 may preferably be provided as shown in FIG. 3 to detect each toner patch. The cover 24 may then be made up of one member that closes all detection surfaces of the five toner concentration sensors 221 to 225 at the same time, the detection surfaces being opposed to the intermediate transfer belt 6. The drive mechanism of the cover may thus be simplified, thereby facilitating the control of the opening and closing of the cover 24.

The cover 24 of the toner concentration sensors 221 to 225 has a lower end portion rotatably held at a predetermined position of the main frame of the image forming apparatus 100 and an upper end portion 2411 rotatably held by the holder 41. The cover 24 may thus close or open the toner concentration sensors 221 to 225 as the holder 41 moves.

In this way, with the cover 24 opened and closed by the holder 41 moving the counter roller 23, the driving portion may be shared, thereby simplifying the drive mechanism and facilitating the control.

With reference to FIGS. 3A to 3C, a cover position detection sensor 63 for detecting the position of the cover 24 is provided at the side of the cover 24. For example, the cover 24 is at the closing position when the cover position detection sensor 63 does not detect the cover 24. The cover 24 is adjusted to be at the opening position when the cover position detection sensor 63 detects the cover 24.

Note that without the cover position detection sensor 63, the toner concentration sensor 22 (221 to 225) may instead detect the position of the cover 24. Specifically, because the toner concentration sensor 22 outputs different signals depending on whether the cover 24 closes or opens the toner concentration sensor 22, the output signal of the toner concentration sensor 22 may be confirmed to detect the position of the cover 24.

Figure 4:
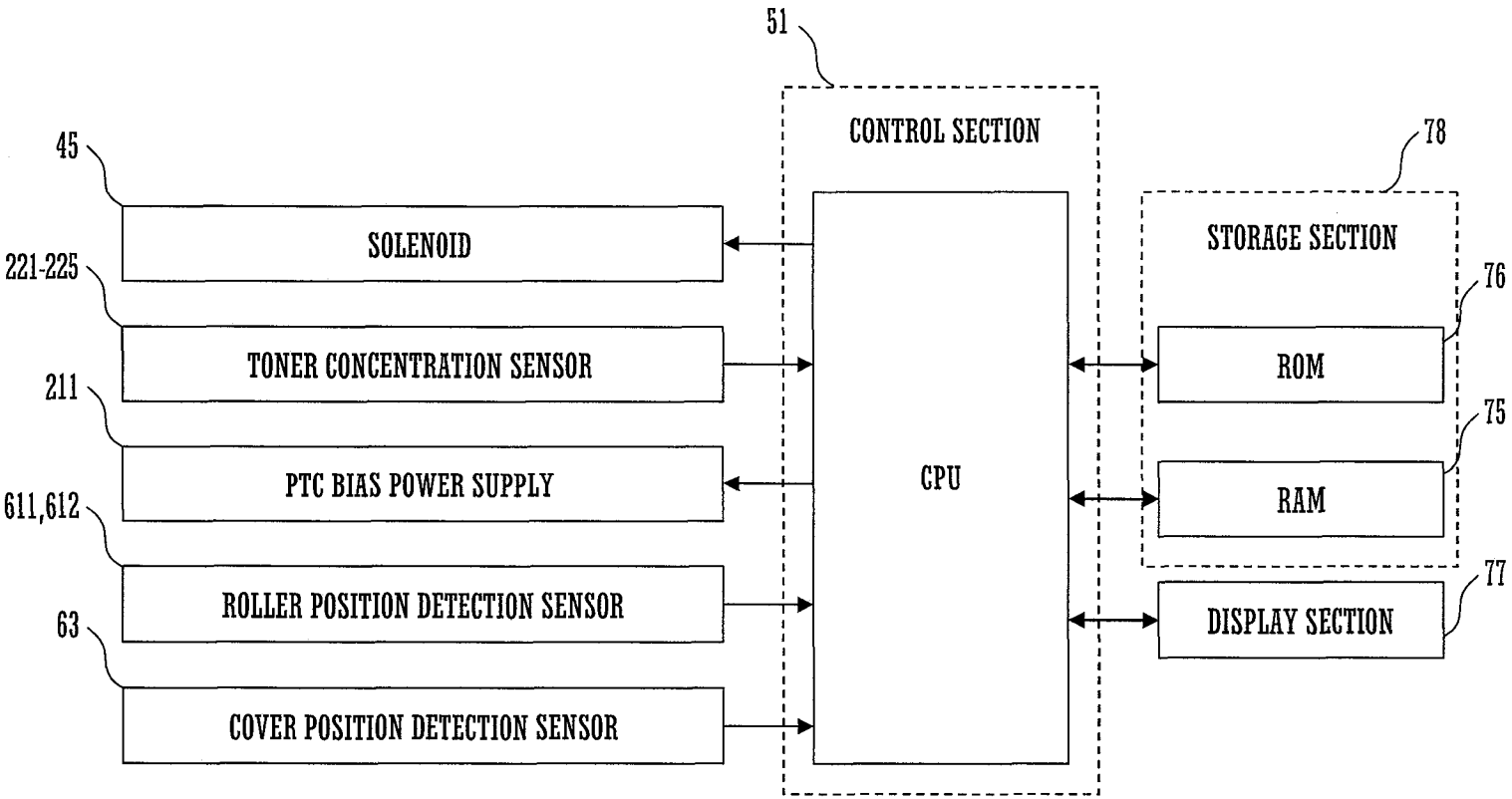
FIG. 4 is a block diagram of the configuration for moving the counter roller.

A description is now given of the configuration of the control system for moving the counter roller 23. The image forming apparatus 100 includes a control section (CPU) 51. With reference to FIG. 4, the control section 51 is connected to the solenoid 45, the toner concentration sensor 22 (221 to 225), the PTC bias power supply 211, the roller position detection sensors 611 and 612, the cover position detection sensor 63, a storage section 78 (a ROM 76, a RAM 75), and a display section 77. The CPU 51 reads a program from the ROM 76 to the RAM 75 and performs the program. Depending on the detection results of the toner concentration sensor 22 (221 to 225), the roller position detection sensors 611 and 612, and the cover position detection sensor 63, the CPU 51 turns on/off the power supply of the solenoid 45 to move the counter roller 23. The CPU 51 also controls, during the image forming process, the PTC bias power supply 211 to allow the PTC 21 to apply a charge to the toner image primarily transferred to the intermediate transfer belt 6. The control section 51 also allows the display section 77 to display an error message or the like.

The image forming apparatus 100 performs the image forming process or the process control process as follows.

Figure 5:
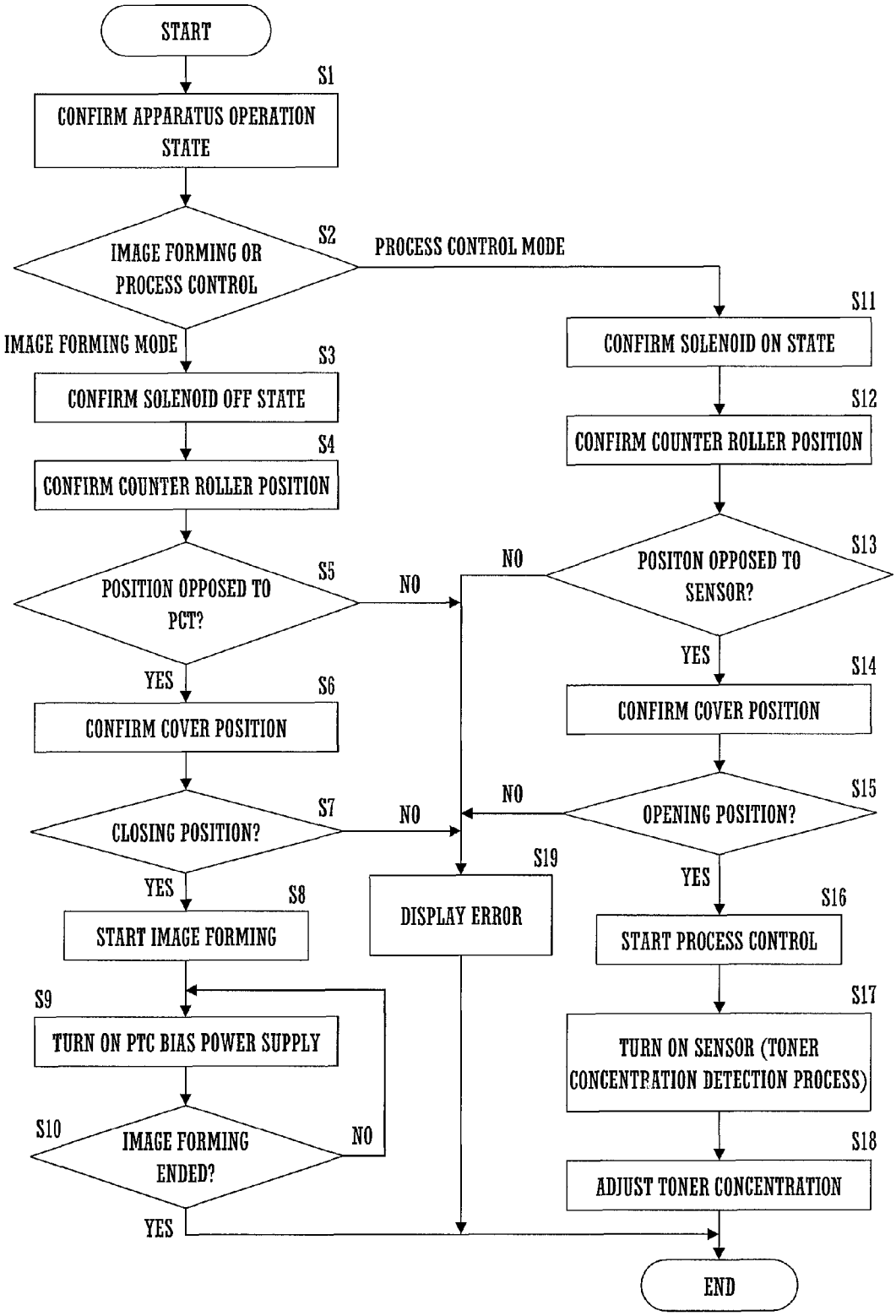
FIG. 5 is a flowchart of an example procedure of an image forming process and a process control process of the image forming apparatus.

With reference to FIG. 5, the control section 51 of the image forming apparatus 100 confirms the operation state (mode) of the apparatus main body (S1).

If the confirmation result shows that the apparatus main body is in the image forming mode (S2), then the control section 51 confirms that the solenoid 45 is in the OFF state (S3).

Figure 6A:
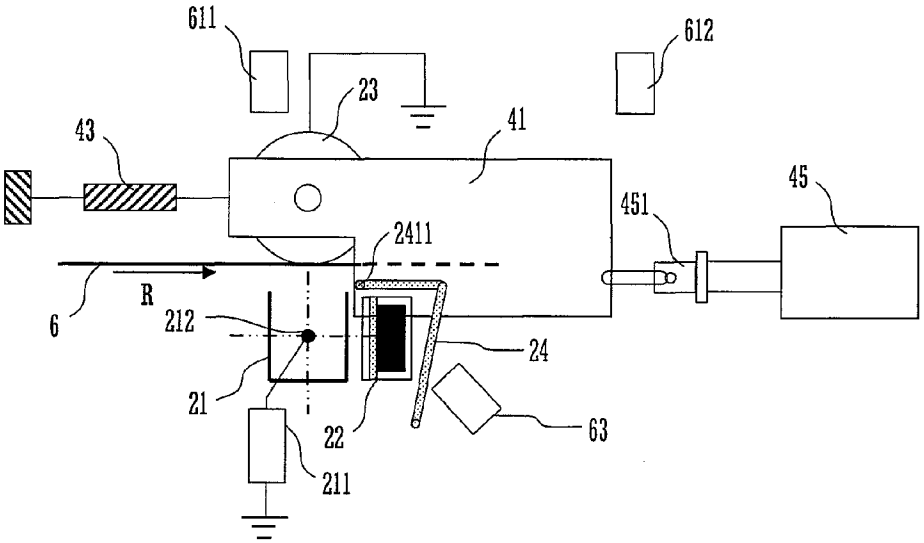
FIG. 6A is a front view of the configuration of the movement mechanism of the counter roller for the counter roller opposed to the PTC.

FIG. 6A shows the state in the image forming process. With reference to FIG. 6A, when the solenoid 45 is turned off, the bar 451 extends to press the holder 41 upstream, thereby contracting the spring 43. The holder 41 is thus moved upstream to oppose the counter roller 23 to the PTC 21. The roller position detection sensor 611 then detects the counter roller 23 and the roller position detection sensor 612 does not detect the counter roller 23, thereby outputting signals showing that the counter roller 23 is at a position opposed to the PTC 21.

The control section 51 confirms the position of the counter roller 23 using the output signals from the roller position detection sensors 611 and 612 (S4).

If the counter roller 23 is not at a position opposed to the electrode 212 of the PTC 21 (S5: N), then there is a possibility of failure, so that the control section 51 allows the display section 77 to display an error (S19) and ends a series of processes. If the counter roller 23 is at a position opposed to the electrode 212 of the PTC 21 (S5: Y), then the control section 51 confirms the position of the cover 24 of the toner concentration sensors 221 to 225 using the output signal from the cover position detection sensor 63 (S6).

With reference to FIG. 6A, if the counter roller 23 is opposed to the PTC 21, then the cover 24 closes the detection surfaces i.e., the upper surfaces of the toner concentration sensors 221 to 225.

If the cover 24 of the toner concentration sensors 221 to 225 is not at the closing position (S7: N), then there is a possibility of failure, so that the control section 51 allows the display section 77 to display an error (S19) and ends a series of processes. If the confirmation result shows that the cover 24 of the toner concentration sensors 221 to 225 is at the closing position (S7: Y), then the control section 51 starts the image forming process (S8).

The control section 51 turns on, during the image forming process, the PTC bias power supply 211 to apply a bias to the PTC electrode 212 (S9) to perform the image forming process (S10). If the image forming process is ended (S10: Y), then the control section 51 ends a series of processes.

If, in step S2, the confirmation result shows that the apparatus main body is in the process control mode, then the control section 51 confirms that the solenoid 45 is in the ON state (S11).

Figure 6B:
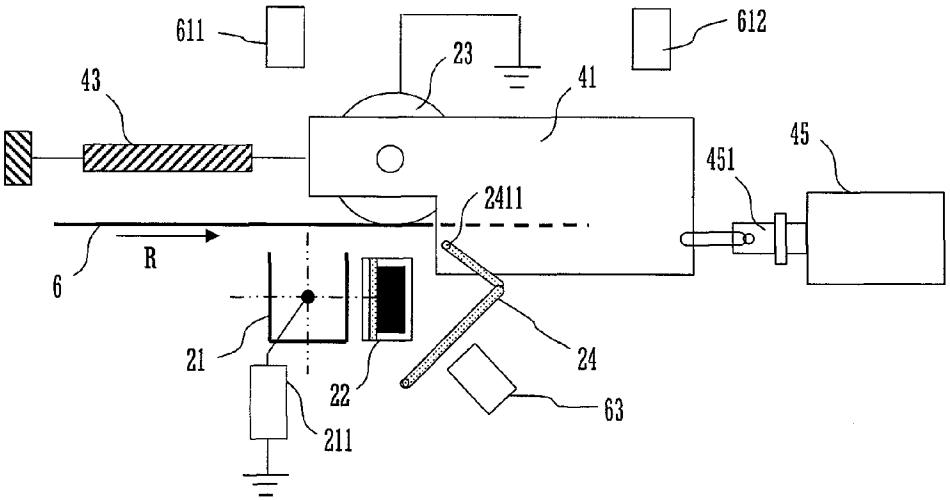
FIG. 6B is a front view of the configuration of the movement mechanism of the counter roller for the counter roller opposed to the toner concentration sensor.

FIG. 6B shows the state in the process control process. With reference to FIG. 6B, when the solenoid 45 is turned on, the bar 451 contracts to allow the spring 43 to press the holder 41 downstream. The holder 41 is then moved downstream to oppose the counter roller 23 to the toner concentration sensors 221 to 225. The roller position detection sensor 611 then does not detect the counter roller 23 and the roller position detection sensor 612 detects the counter roller 23, thereby outputting signals showing that the counter roller 23 is at a position opposed to the toner concentration sensors 221 to 225.

The control section 51 confirms the position of the counter roller 23 using the output signals from the roller position detection sensors 611 and 612 (S12).

If the counter roller 23 is not at a position opposed to the toner concentration sensors 221 to 225 (S13: N), then there is a possibility of failure, so that the control section 51 allows the display section 77 to display an error (S19) and ends a series of processes. If the counter roller 23 is at a position opposed to the toner concentration sensors 221 to 225 (S13: Y), then the control section 51 confirms the position of the cover 24 of the toner concentration sensors 221 to 225 using the output signal from the cover position detection sensor 63 (S14).

With reference to FIG. 6B, if the counter roller 23 is opposed to the toner concentration sensors 221 to 225, then the cover 24 opens the upper surfaces (the detection surfaces) of the toner concentration sensors 221 to 225.

If the cover 24 of the toner concentration sensors 221 to 225 is not at the opening position (S15: N), then there is a possibility of failure, so that the control section 51 allows the display section 77 to display an error (S19) and ends a series of processes. If the confirmation result shows that the cover 24 of the toner concentration sensors 221 to 225 is at the opening position (S15: Y), then the control section 51 starts the process control process (S16).

The control section 51 allows the toner concentration sensors 221 to 225 to detect the concentration of the toner patch transferred onto the intermediate transfer belt 6 (S17), then adjusts the toner concentration, and ends the process (S18).

Figure 7A:
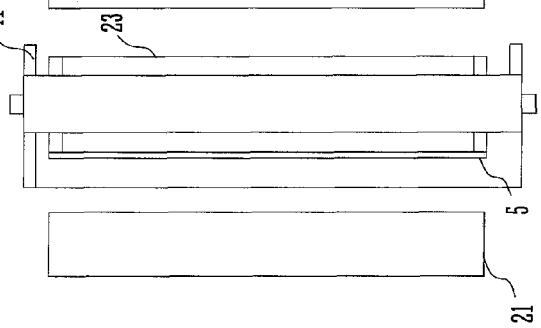
FIG. 7A is a side view of the configuration of the movement mechanism of the counter roller having a different cover shape from that in FIG. 3.
Figure 7B:
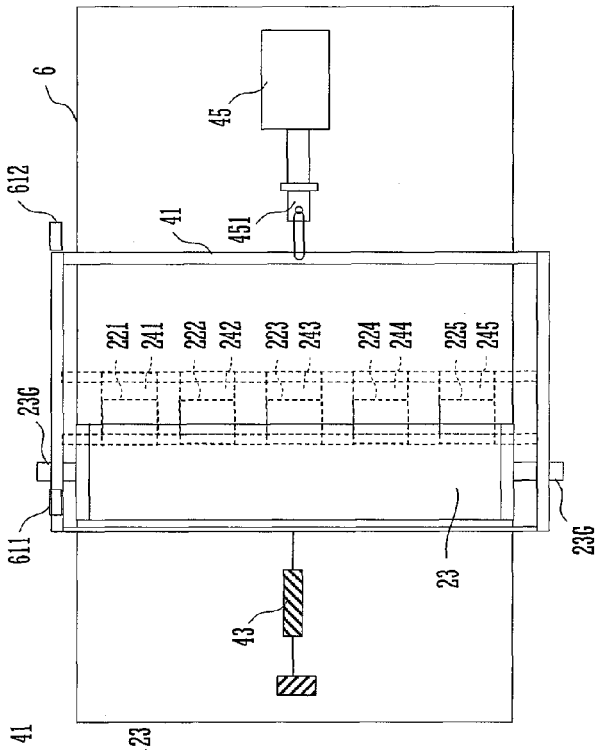
FIG. 7B is a plan view of the configuration of the movement mechanism of the counter roller having a different cover shape n from that in FIG. 3.
Figure 7C:
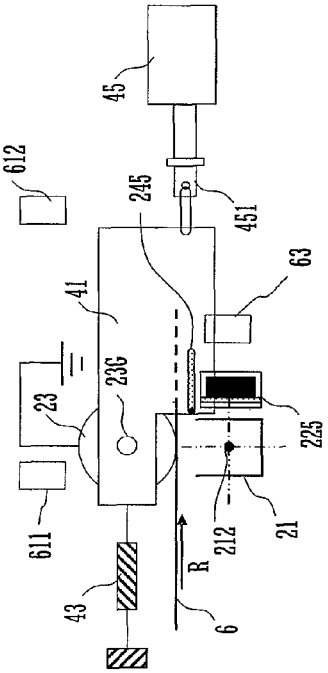
FIG. 7C is a front view of the configuration of the movement mechanism of the counter roller having a different cover shape from that in FIG. 3.

Note that if a plurality of toner concentration sensors are provided as described above with respect to FIG. 3B, covers of the respective toner concentration sensors may be provided, and each cover may open and close in cooperation with the position of the counter roller 23. For example, with reference to FIGS. 7A to 7C, for five toner concentration sensors 221 to 225 provided, covers 241 to 245 of the toner concentration sensors may be attached to the holder 41, and depending on the motion of the counter roller 23, the covers 241 to 245 may be opened or closed collectively, such as with the covers 241 to 245 being in cooperation with each other. Driving portions for opening and closing the covers 241 to 245 may be individually provided and each driving portion may collectively close or open the covers 241 to 245 depending on the position of the counter roller 23. Thus, for increased number of toner concentration sensors, each cover may not be enlarged but may be reduced, thereby reducing the cost of the members used for the cover. Regardless of the number of toner concentration sensors, the opening and closing of the cover may be easily controlled.

As described above, according to the present invention, the counter roller 23 works both as a roller opposed to the PTC 21 and as a roller opposed to the toner concentration sensor 22 (221 to 225). Less rollers may thus be used to extend the intermediate transfer belt 6, thereby reducing the wear of the intermediate transfer belt 6 to improve the durability thereof. Also, during the image forming process, the PTC 21 may apply a uniform charge onto the toner image of the intermediate transfer belt 6, and the toner concentration sensor 22 may accurately detect the toner patch image, thereby improving the transferability to form a higher quality image.

Note that the above description shows an example where the PTC 21 is disposed upstream of the toner concentration sensor 22, the PTC 21 may also be disposed downstream of the toner concentration sensor 22. This is because the image forming process and the toner concentration detection process are performed at different timings and so the PTC 21 and the toner concentration sensor 22 are not used at the same time, as described above.

Although the above description shows a configuration in which the spring 43 and the solenoid 45 together move the holder 41, the solenoid 45 may be connected to the holder 41 to move the holder 41 without the spring 43.

Although the above description shows a configuration in which the cover 24 is opened or closed as the holder 41 moves, an opening and closing section (an opening and closing mechanism) for opening and closing the cover 24 may be separately provided.

The described embodiments are to be considered in all respects as illustrative and not restrictive. It should be appreciated that the scope of the invention is not limited to the described embodiments, but rather is defined by the appended claims. All changes that come within the meaning and scope of the appended claims and any equivalents thereof are intended to be embraced within the scope of the invention.

What is claimed is:

1. An image forming apparatus comprising:

an intermediate transfer belt extended into a loop by a plurality of rollers, the intermediate transfer belt receiving a toner image primarily transferred from an image bearing member and conveying the image to a secondary transfer position;

a concentration detection section opposed to the intermediate transfer belt, the concentration detection section being for detecting the concentration of the toner image primarily transferred to the intermediate transfer belt to control the concentration of the toner image formed on the image bearing member;

a pre-secondary-transfer charging section disposed adjacent to the concentration detection section in the conveyance direction of the toner image primarily transferred to the intermediate transfer belt, the pre-secondary-transfer charging section being for applying a charge to the toner image primarily transferred to the intermediate transfer belt to reduce the variation of the charge amount of the toner image;

a counter roller being one of the rollers extending the intermediate transfer belt, the counter roller being movable between a first position opposed to the pre-secondary-transfer charging section across the intermediate transfer belt and a second position opposed to the concentration detection section across the intermediate transfer belt; and a movement section for moving the counter roller to the first position when the pre-secondary-transfer charging section applies a charge to the toner image, and for moving the counter roller to the second position when the concentration detection section detects the concentration of the toner image.

2. The image forming apparatus according to claim 1, wherein the counter roller is a driven roller driven by the intermediate transfer belt, and wherein the movement section comprises a movement mechanism for moving the counter roller in parallel with the intermediate transfer belt.

3. The image forming apparatus according to claim 1, further comprising:

a cover member movable between a closing position and an opening position, the closing position closing and the opening position opening a surface of the concentration detection section that is opposed to the intermediate transfer belt; and an opening and closing section for moving the cover member to the closing position when the pre-secondary-transfer charging section applies a charge to the toner image, and for moving the cover member to the opening position when the concentration detection section detects the concentration of the toner image.

4. The image forming apparatus according to claim 3, wherein the concentration detection section is provided in a plurality in a direction perpendicular to the conveyance direction of the toner image transferred to the intermediate transfer belt, and wherein the cover member comprises one member that is able to close all surfaces of the concentration detection sections, the surfaces being opposed to the intermediate transfer belt.

5. The image forming apparatus according to claim 3, wherein the concentration detection section is provided in a plurality in a direction perpendicular to the conveyance direction of the toner image transferred to the intermediate transfer belt, wherein the cover member comprises a plurality of members that individually close surfaces of the concentration detection sections, the surfaces being opposed to the intermediate transfer belt, and wherein the opening and closing section collectively moves the members to the closing position or the opening position.

* * * * *